US007252248B2

(12) United States Patent
Cutler

(10) Patent No.: US 7,252,248 B2
(45) Date of Patent: Aug. 7, 2007

(54) KITCHEN AERATOR HAVING A FLOW COMPENSATOR

(75) Inventor: William Cutler, Cedar Knolls, NJ (US)

(73) Assignee: Niagara Conservation Corporation, Cedar Knolls, NJ (US)

( * ) Notice: Subject to any disclaimer, the term of this patent is extended or adjusted under 35 U.S.C. 154(b) by 78 days.

(21) Appl. No.: 11/281,148

(22) Filed: Nov. 17, 2005

(65) Prior Publication Data

US 2007/0108314 A1 May 17, 2007

(51) Int. Cl.
*E03C 1/08* (2006.01)

(52) U.S. Cl. ..... 239/428.5; 239/443; 239/581.1; 239/582.1; 239/583; 239/586; 239/587.4; 137/309

(58) Field of Classification Search ..... 239/428.5, 239/447, 449, 581.1, 581.2, 582.1, 586, 587.4, 239/569, 583; 251/309, 209; 4/678
See application file for complete search history.

(56) References Cited

U.S. PATENT DOCUMENTS 2,986,341 A * 5/1961 Goodrie ..... 239/428.5
4,290,152 A * 9/1981 Kesselman, Sr. ..... 4/678
6,142,389 A * 11/2000 Kynett ..... 239/447

* cited by examiner

*Primary Examiner*—Dinh Q. Nguyen
(74) *Attorney, Agent, or Firm*—Ezra Sutton, Esq.

(57) ABSTRACT

A faucet aerator incorporating a flow compensator in order to allow higher flow rates of water at lower water pressures through the faucet aerator, including a faucet housing having an annular flow channel configured along a longitudinal axis through the faucet housing for the passing of water through the annular flow channel. The faucet housing includes a flow compensator sub-assembly connected to a spray sub-assembly for forming the faucet aerator. The flow compensator sub-assembly includes a flow compensator member having a plurality of spaced-apart water hole openings for allowing water at a high flow rate therethrough, a seat member for seating and holding the flow compensator in place and a flow compensator ball joint having an exterior threaded section for connecting and attaching to a connection ring of a faucet, a pin receiving opening for receiving a pin therethrough and a ball joint member for receiving a seat joint swivel member thereon for allowing the swivel member to swivel in a 360 degree rotation in either a clockwise or counterclockwise direction. The pin includes a water flow opening, a first arm opening and a second arm opening and a flip lever having a first arm and a second arm; the first arm opening and the second arm opening of the pin for receiving the first arm and the second arm of the flip lever therein, respectively. The flip lever being movable from a first water flow position to a second water flow position in order to regulate the water flow rate for a particular spraying pattern.

6 Claims, 5 Drawing Sheets

KITCHEN AERATOR HAVING A FLOW COMPENSATOR

FIELD OF THE INVENTION

The prevent invention relates to a kitchen aerator incorporating a flow compensator in order to allow higher flow rates of water at lower water pressures. More particularly, the flow compensator includes a flip lever that is bent at an angle for ease of use in regulating the water flow rate.

BACKGROUND OF THE INVENTION

Aerator nozzles, aerator faucets, aerator heads, kitchen aerators, spray heads, showerheads and the like for controlling fluid (water) spray are well-known in the prior art. The aforementioned aerator faucets for the kitchen are generally complicated mechanical devices with numerous component parts which have water discharge heads that are merely rotated for regulating the discharge spray of water from the discharge/spray head. These types of rotating spray heads easily break down because of the numerous internal moving component parts, and once inoperative the spray head is usually replaced and not fixed.

There remains a need for a kitchen aerator having a flow compensator for regulating high flow rates at low water pressures. The flow compensator should include a flip lever being bent at an angle for easy use in order to regulate the water flow rate. The flow compensator's unique design will have results such that there is higher flow rates (60 to 80 PSI) at lower water pressures while maintaining the desired maximum output at 80 PSI and give flow rates that are within a flow variance range of 15% from 20 PSI to 80 PSI.

DESCRIPTION OF THE PRIOR ART

Kitchen aerators, aerator heads, aerator nozzles, aerator faucets, spray heads, showerheads and the like having various designs, configurations, structures and materials of construction have been disclosed in the prior art. For example, U.S. Pat. No. 4,221,338 to SHAMES, et al. discloses a spray and aerator faucet appliance wherein the selection of water discharge is effected by merely rotating the water discharge head portion of the appliance until the desired water discharge from the appliance appears. Selectivity is achieved by providing two abutting internal parts, each with a flow passageway located eccentric of the axis of the appliance, with seal means for the eccentric flow passageway provided between the abutting parts, for permitting selection either of flow only through the eccentric flow passageways when aligned, or no flow through the eccentric passageways when not aligned, thereby permitting discharge of flow through an alternate flow path. This prior art patent does not disclose or teach the concept of the present invention of a kitchen aerator having a flow compensator within the spray head of the aerator.

U.S. Pat. No. 4,598,866 to CAMMACK et al. discloses a showerhead having a hollow housing with front and rear openings and a closure in the front opening which defines the first and second groups of flow outlets. The showerhead is secured to a supply pipe by a nut which has a snout to captivate a ball and fix the position of a shank that projects from the ball and around which the housing is rotatable. A flow control device rotationally fixed on the shank enables selection of liquid flow through the ball and shank to selected ones of first and second channels that lead to corresponding first and second groups of flow outlets as the housing is rotated about the shank. This prior art patent does not disclose or teach the concept of the present invention of a kitchen aerator having a flow compensator within the spray head of the aerator.

U.S. Pat. No. 5,383,604 to BOESCH discloses a water outlet head for a sanitary fitting having a shower outlet and a jet outlet, comprising a diverter valve and a manual operator with an elastic cover cap mounted in a housing. The handheld water outlet head includes a piston carrying a valve disk movable between two seats for selectively directing an incoming water flow to an aerator nozzle via ducts. Incoming water pressure holds the valve disk in the spray position against the force of a spring which returns the disk to a nozzle position when the water is turned off, unless a rocker arm is latched by a slider. This prior art patent doses not disclose or teach the concept of the present invention of a kitchen aerator having a flow compensator within the spray head of the aerator.

U.S. Pat. No. 6,065,498 to CAMPAU discloses a flow control device for providing variable resistance to liquid flow through a flow passageway. A cylindrical housing communicates with the passageway. The housing has a sidewall, and an inlet and an outlet each disposed at two ends. A vortex generator is located within the housing, and has a base spaced from the inlet end of the housing and an annular flow guide radially spaced from the housing sidewall. The flow guide includes a number of slots. Liquid enters the housing through the inlet and is directed outside the vortex generator and through the slots. This creates a vortex flow path within the generator as the liquid flows to the housing outlet, so that as the pressure of the liquid at the inlet increases, the flow factor of the device decreases to reduce the liquid flow rate through the device at higher inlet pressures. This prior art patent does not disclose or teach the concept of the present invention of a kitchen aerator having a flow compensator within the spray head of the aerator.

U.S. Pat. No. 6,296,011 to ESCHE et al. discloses a three position valve suitable for use in a trigger nozzle assembly being suitable for use in kitchen utensil rinsing areas has a valve housing with a bore, a fluid inlet and a fluid outlet. A biased slidable member is positioned in the bore and provides for fluid flow between the fluid inlet and outlet when the valve is in a first position. High flow and stop flow positions are also provided upon compression of the trigger. The valve can be employed in conjunction with a combined spray and aerator head, as well as a hose take-up assembly. This prior art patent does not disclose or teach the concept of the present invention of a kitchen aerator having a flow compensator within the spray head of the aerator.

None of the aforementioned prior art references disclose or teach the basic structure of a kitchen aerator with a flow compensator to increase the flow rate of water at low pressures using a flip lever to regulate the water flow rate.

Accordingly, it is an object of the present invention to provide a kitchen or faucet aerator that includes a flow compensator in order to allow higher flow rates of water at lower water pressures; such that the flow compensator's unique design will give results of higher flow rates (60 to 80 PSI) at lower water pressures while maintaining a desired maximum output at 80 PSI and give flow rates that are within a flow variance range of 15% from 20 PSI to 80 PSI.

Another object of the present invention is to provide a kitchen aerator having a flip lever within the flow compensator, such that the flip lever is bent at an angle for easy use in order to regulate the water flow rate for a particular spraying pattern.

Another object of the present invention is to provide a kitchen aerator having a minimum number of moving parts for easy replacement of defective, damaged or broken component parts of the kitchen aerator.

Another object of the present invention is to provide a kitchen aerator that is durable, lightweight and easy to use by the user.

A further object of the present invention is to provide a kitchen aerator having a flow compensator that can be mass-produced in an automated and economical manner and is readily affordable by the consumer.

SUMMARY OF THE INVENTION

In accordance with the present invention, there is provided a faucet aerator incorporating a flow compensator in order to allow higher flow rates of water at lower water pressures through the faucet aerator. The faucet aerator includes a faucet housing having an annular flow channel configured along a longitudinal axis through the faucet housing for the passing of water through the annular flow channel. The faucet housing includes a flow compensator sub-assembly connected to a spray sub-assembly for forming the faucet aerator. The flow compensator sub-assembly includes a flow compensator member having a plurality of spaced-apart water hole openings for allowing water at a high flow rate therethrough, a seat member for seating and holding the flow compensator in place and a flow compensator ball joint having an exterior threaded section for connecting and attaching to a connection ring of a faucet, a pin receiving opening for receiving a pin therethrough and a ball joint member for receiving a seat joint swivel member thereon for allowing the swivel member to swivel in a 360 degree rotation in either a clockwise or counterclockwise direction. The pin includes a water flow opening, a first arm opening and a second arm opening and a flip lever having a first arm and a second arm; the first arm opening and the second arm opening of the pin for receiving the first arm and the second arm of the flip lever therein, respectively. The flip lever being movable from a first water flow position to a second water flow position in order to regulate the water flow rate for a particular spraying pattern.

BRIEF DESCRIPTION OF THE DRAWINGS

Further objects, features and advantages of the present invention will become apparent upon the consideration of the following detailed description of the presently-preferred embodiment when taken in conjunction with the accompanying drawings, wherein.

DETAILED DESCRIPTION OF THE PREFERRED AND ALTERNATE EMBODIMENTS

Preferred Embodiment 10

Figure 1:
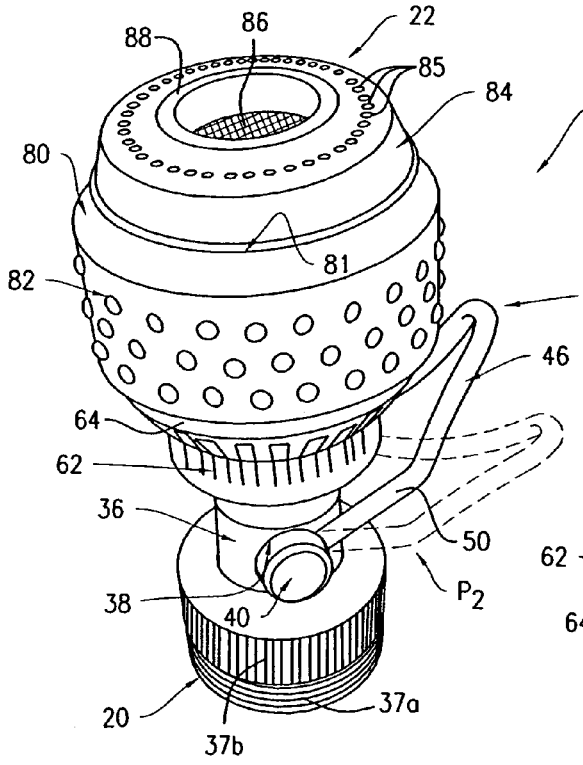
FIG. 1 is a front perspective view of the kitchen aerator of the preferred embodiment of the present invention showing the kitchen aerator in an assembled state ready for operational use thereof.
Figure 2:
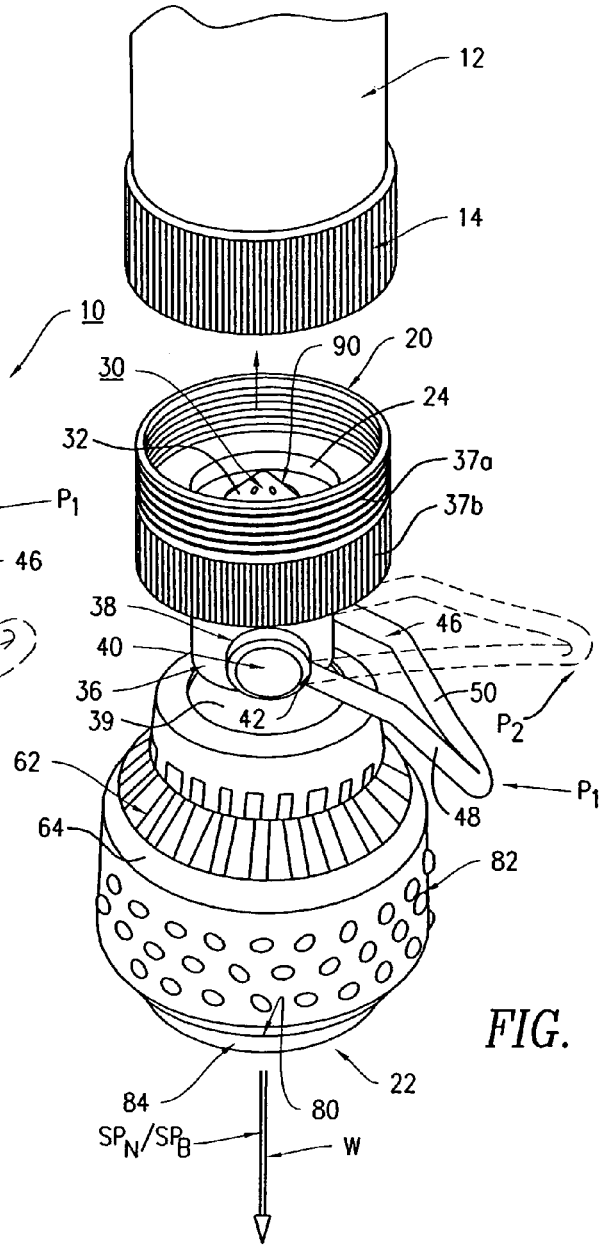
FIG. 2 is a rear perspective view of the kitchen aerator of the present invention showing the kitchen aerator in an assembled state ready for operational use thereof.
Figure 3:
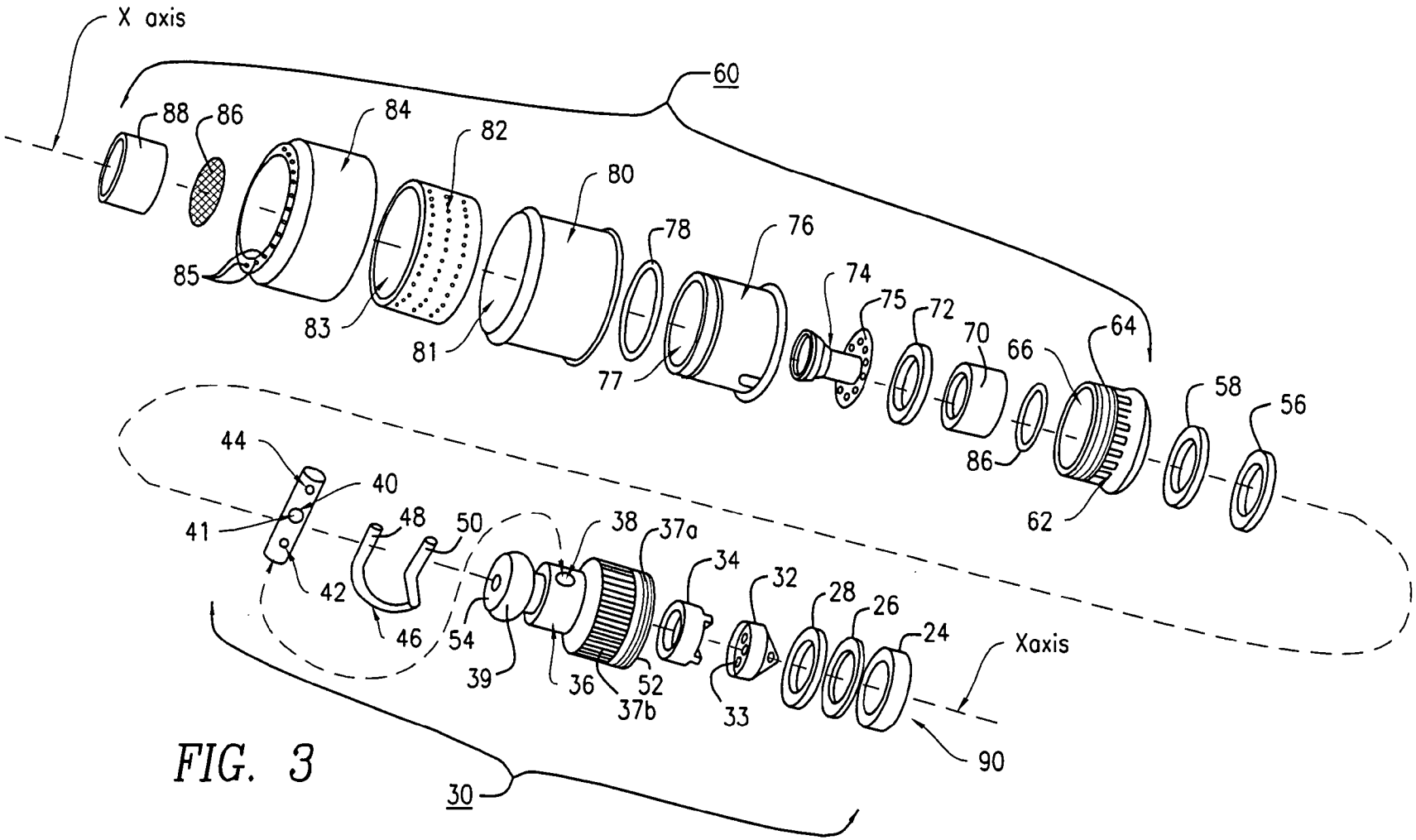
FIG. 3 is an exploded perspective view of the kitchen aerator of the present invention showing all of the major component parts contained thereto.
Figure 3A:
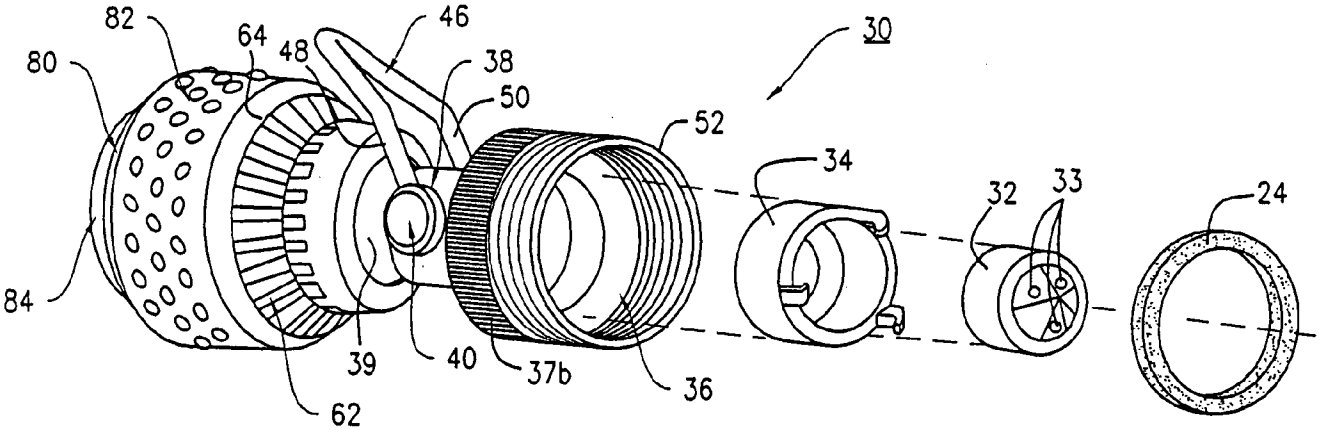
FIG. 3A is an exploded perspective view of the kitchen aerator of the present invention showing a flow compensator member, a flow compensator seat member, and a flow compensator ball joint having a pin member and a flip lever.
Figure 3B:
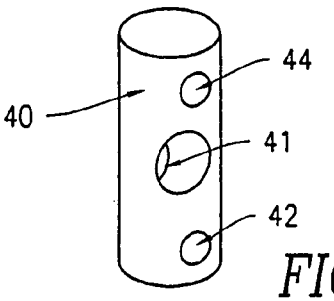
FIG. 3B is a perspective view of the kitchen aerator of the present invention showing the pin member for use with the flip lever.
Figure 4:
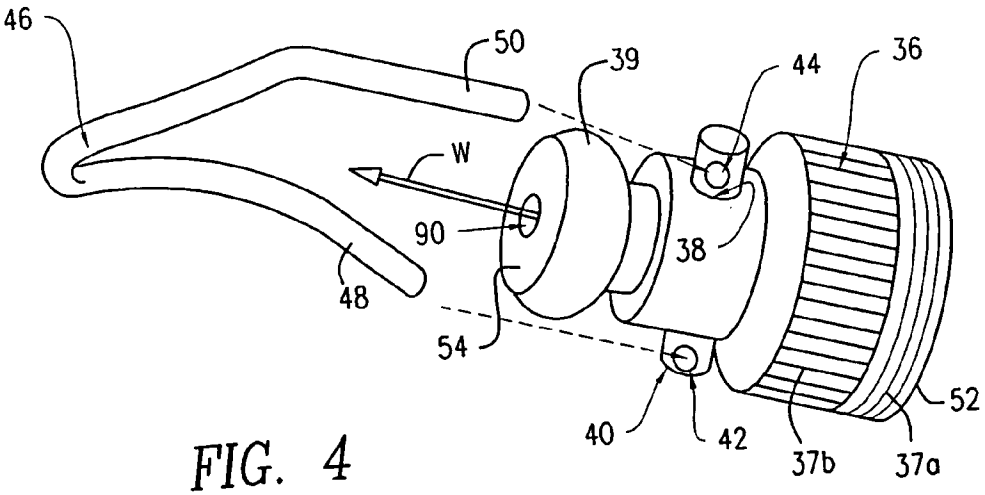
FIG. 4 is an exploded perspective view of the kitchen aerator of the present invention showing a flip lever being attached to a flow compensator ball joint.

The kitchen aerator or faucet aerator 10 having a flow compensator member 32 and its component parts of the preferred embodiment of the present invention are represented in detail by FIGS. 1 through 4 of the patent drawings. The kitchen aerator 10 incorporating the flow compensator member 32 is used to increase the flow rate R of water W at low pressures P using a flip lever 46 to regulate the water flow rate R from a kitchen faucet 12. As shown in FIGS. 1, 3 and 4, the kitchen aerator 10 includes a proximal end 20 and a distal end 22. Starting with the proximal end 20, the kitchen aerator 10 includes a first washer 24, a second washer 26 and a third washer 28 connecting to a flow compensator sub-assembly 30. The flow compensator sub-assembly 30 includes a flow compensator member 32 having a plurality of spaced-apart water hole openings 33, a flow compensator seat member 34, a flow compensator ball joint 36, a pin 40 having a water flow opening 41, a first arm opening 42 and a second arm opening 44, and an angled and U-shaped flip lever 46 having a first arm 48 and a second arm 50. The flow compensator ball joint 36 includes an exterior threaded section 37*a* having an exterior gripping section 37*b* for connecting and attachment to a connection ring 14 (having interior threads not shown) of kitchen faucet 12; a pin receiving opening 38 and a ball joint member 39. Ball joint 36 also includes a first end 52 and a second end 54. Threaded section 37 of ball joint 36 is configured at the first end 52 of the flow compensator ball joint 36, as shown in FIG. 2. The flow compensator member 32 is detachably connected to the seat member 34, and the seat member 34 being detachably connected to the first end 52 of ball joint 36. As shown in FIG. 4, pin 40 is received within pin receiving opening 38 of ball joint 36 and first and second pin arm openings 42 and 44 are for receiving the first and second arms 48 and 50, respectively, of flip lever 46. The second end 54 of ball joint 36 is used to connect with first and second O-ring members 56 and 58, respectively, as shown in FIG. 3. Flip lever 46 is movable from a first water flow position $P_1$ to a second water flow position $P_2$ in order to regulate the water flow rate for a particular spraying pattern. Flow compensator member 32 of the flow compensator sub-assembly 30 is able to have higher flow rates (60 to 80 PSI) at lower water pressures while maintaining the desired maximum output flow rate at 80 PSI and give flow rates during operational use that are within a flow variance range of 15% from 20 PSI to 80 PSI.

As shown in FIGS. 1 and 3, the kitchen aerator 10 further includes a spray sub-assembly 60 connecting to the flow compensator sub-assembly 30. The spray sub-assembly 60 includes a seat joint member (seat joint swivel member) 62 having a threaded end 64 and a seat joint opening 66, a third O-ring member 68, an interior seat joint member 70 and a water stopping packing member 72. The spray sub-assembly 60 also includes an exchanging cartridge member 74, a water out seat joint member 76, a fourth O-ring member 78, a chrome spray adjusting ring 80, a rubber spray adjusting ring 82, a water out seat member (spray head member) 84, a mesh filter member 86 and a filter fixed ring 88. The seat joint opening 66 at the non-threaded end 63 of the seat joint member 62 is used to receive the O-ring members 56 and 58, as well as the ball joint section 39 at the second end 54 of ball joint 36 of the flow compensator sub-assembly 30. The ball joint member 39 allows the seat joint swivel member 62 to swivel in 360 degree rotation in either a clockwise or counter-clockwise direction. The interior seat joint member 70 and the third O-ring member 68 are removably received within seat joint opening 66 of seat joint member 62. The water stopping packing member 72 is detachably connected to the interior seat joint member 70, as shown in FIG. 3 of the drawings. The water stopping packing member 72 is also adjacent and in contact with a screen section 75 of the exchanging cartridge member 74. The exchanging cartridge member 74 is received within a seat joint opening 77 of the water out seat joint member 76. The interior seat joint member 70, the water stopping packing member 72, the exchanging cartridge member 74 and the water out seat joint member 76 are all internal spray components of the spray sub-assembly 60 that are used to produce a needle spray pattern $SP_N$ or a bubble stream (full) spray pattern $SP_B$. The fourth O-ring member 78 and the water out seat joint member 76 are received within a chrome spray ring opening 81 of the chrome spray adjusting ring 80, as shown in FIGS. 2 and 3. The chrome spray adjusting ring 80 is received within a rubber spray ring opening 83 of the rubber spray adjusting ring 82. The spray adjusting rings 80 and 82 move backward and forward in a lateral motion in order to give the aforementioned needle spray pattern $SP_N$ or the bubble stream (full) spray pattern $SP_B$, as shown in FIG. 2 of the drawings, when in operational use. The rubber spray ring opening 83 of rubber spray adjusting ring 82 is used for receiving the water out seat member 84. The mesh filter member 86 is adjacent and in contact with the fourth O-ring member 78 and the fourth O-ring member 78 is adjacent and in contact with the water out seat joint member 76. The mesh filter member 86 is fixed in place with the filter fixed ring 88, as shown in FIG. 1 of the drawings. The water out seat member 84 includes a plurality of spaced-apart (in a circular configuration) water openings 85 for producing the aforementioned spray patterns $SP_N$ or $SP_B$, etc. An annular flow channel 90 is provided in the assembled configuration (See FIGS. 1 and 2) for the flow of water W through the kitchen aerator 10. The annular flow channel 90 is configured to be oriented along a longitudinal axis X of the kitchen aerator 10, as shown in FIG. 3.

Alternate Embodiment 100

Figure 5:
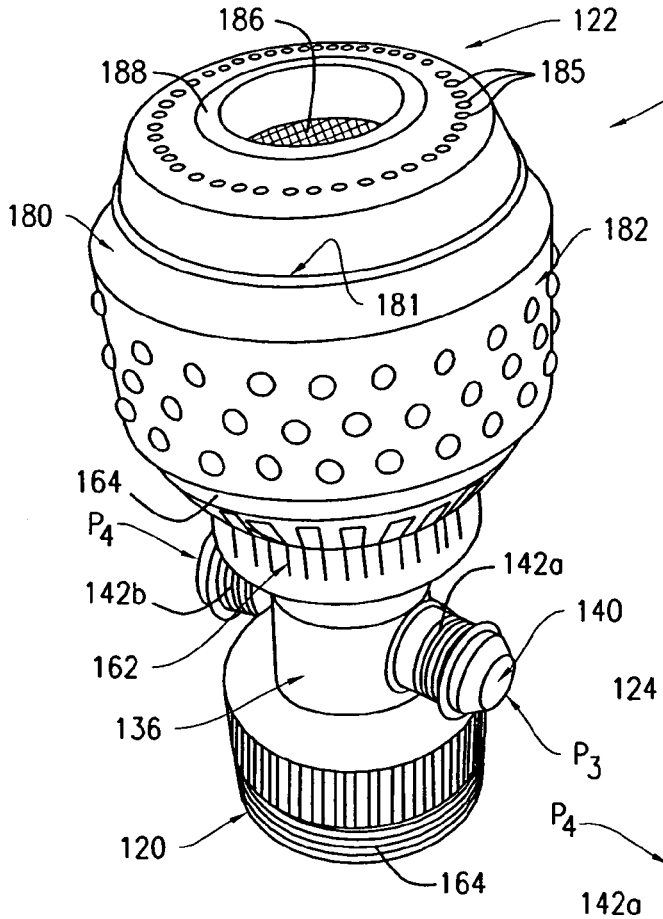
FIG. 5 is a front perspective view of the kitchen aerator of the alternate embodiment of the present invention showing the kitchen aerator in an assembled state ready for operational use thereof.
Figure 6:
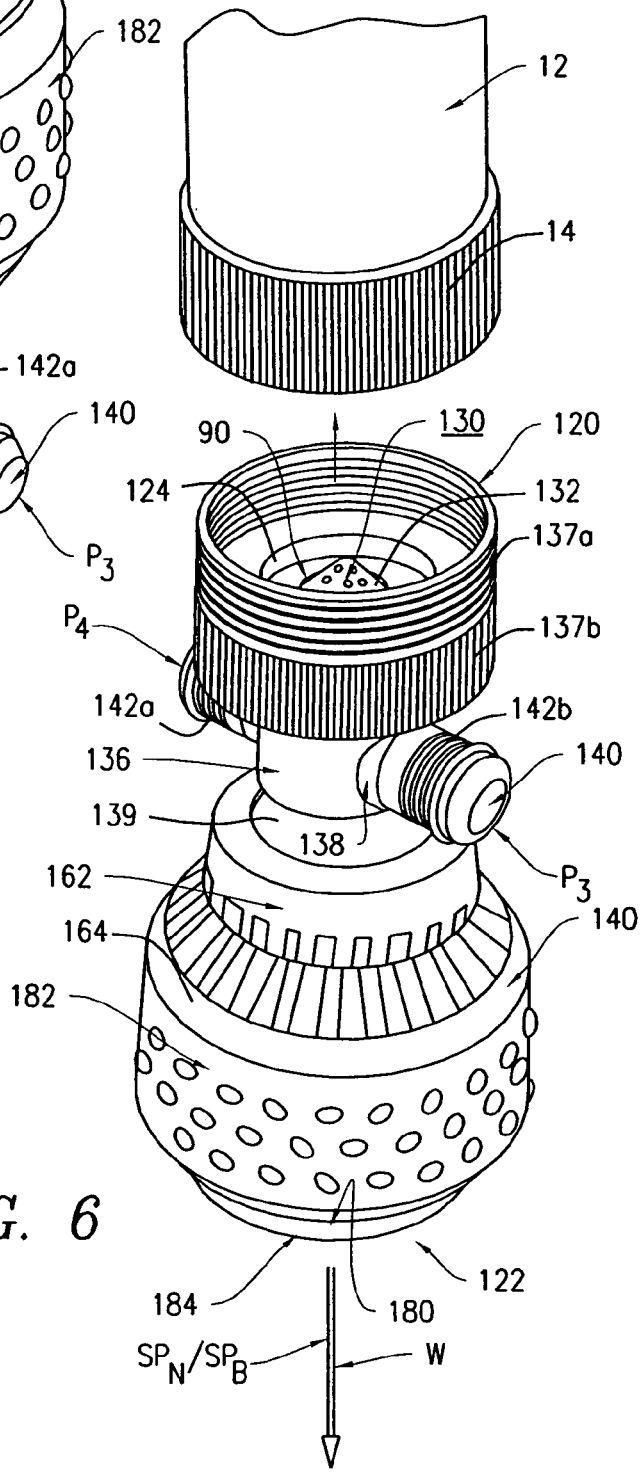
FIG. 6 is a rear perspective view of the kitchen aerator of the present invention showing the kitchen aerator in an assembled state ready for operational use thereof.
Figure 7:
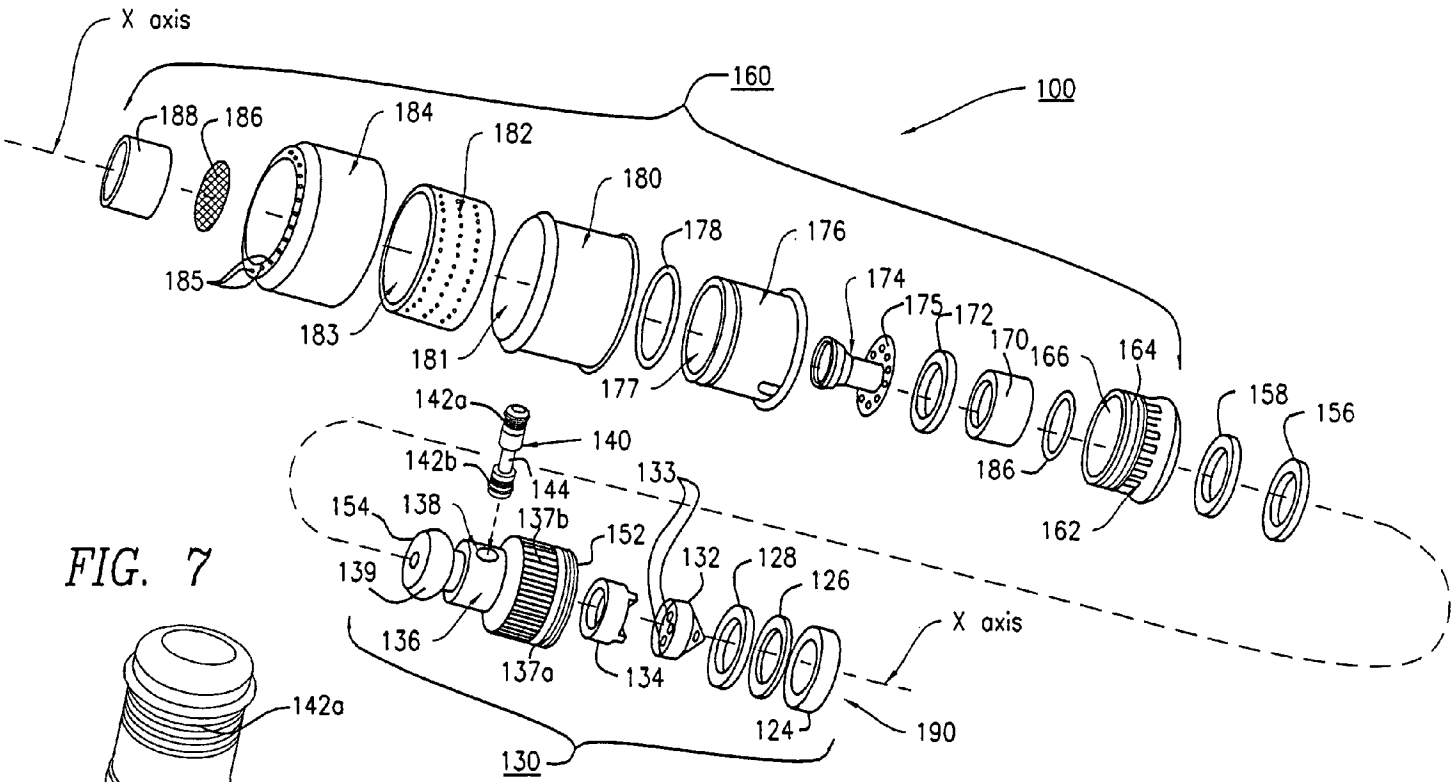
FIG. 7 is an exploded perspective view of the kitchen aerator of the present invention showing all of the major component parts contained thereto.
Figure 8:
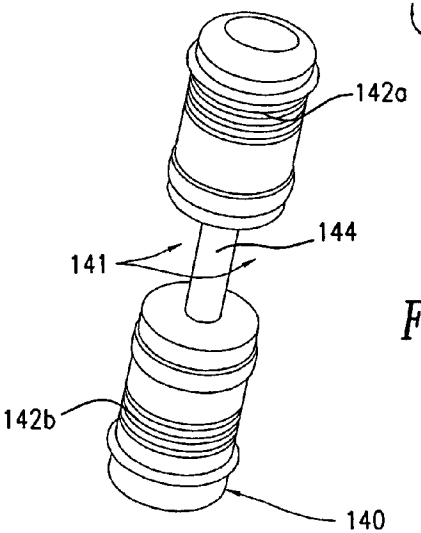
FIG. 8 is a perspective view of the kitchen aerator of the present invention showing a pin member for use within a flow compensator ball joint.

The kitchen aerator or faucet aerator 100 having a flow compensator member 132 and its component parts of the preferred embodiment of the present invention are represented in detail by FIGS. 5 through 8 of the patent drawings. The kitchen aerator 100 incorporating the flow compensator member 132 is used to increase the flow rate R of water W at low pressures P using a flip lever 146 to regulate the water flow rate R from a kitchen faucet 12. As shown in FIGS. 4 and 7, the kitchen aerator 100 includes a proximal end 120 and a distal end 122. Starting with the proximal end 120, the kitchen aerator 100 includes a first washer 124, a second washer 126 and a third washer 128 connecting to a flow compensator sub-assembly 130. The flow compensator sub-assembly 130 includes a flow compensator member 132 having a plurality of spaced-apart water hole openings 133, a flow compensator seat member 134, a flow compensator ball joint 136 having an exterior threaded section **137*a* adjacent to an exterior gripping section 137*b* for connecting and attaching to a connection ring 14 of the kitchen faucet 12, a pin receiving opening 138 and a ball joint member 139, and a pin 140 having a water flow section 141. Pin 140 further includes gripping ends 142*a* and 142*b*. The water flow section 141 includes an off-set pin bar 144 connecting each of the gripping ends 142*a* and 142*b* of pin 140 together in order to form the water flow section 141, as depicted in FIG. 8. Ball joint 136 also has a first end 152 and a second end 154. Exterior threaded section 137*a* of ball joint 136 is configured at the first end 152 of the flow compensator ball joint 136, as shown in FIG. 5 of the drawings. The flow compensator member 132 is detachably connected to the seat member 134, and the seat member 134 being detachably connected to the first end 152 of ball joint 136. As shown in FIGS. 5 and 7, pin 140 is received within pin receiving opening 138 of ball joint The second end 154 of ball joint 136 is used to connect with first and second O-ring members 156 and 158, respectively, as shown in FIG. 7. Pin 140 is movable from a first water flow position $P_3$ to a second water flow position $P_4$ in order to regulate the water flow rate for a particular spraying pattern. Flow compensator member 132 of the flow compensator sub-assembly 130** is able to have higher flow rates (60 to 80 PSI) at lower water pressures while maintaining the desired maximum output flow rate at 80 PSI and give flow rates during operational use that are within a flow variance range of 15% from 20 PSI to 80 PSI.

As shown in FIGS. 5 and 7, the kitchen aerator 100 further includes a spray sub-assembly 160 connecting to the flow compensator sub-assembly 130. The spray sub-assembly 160 includes a seat joint member 162 having a threaded end 164 and a seat joint opening 166, a third O-ring member 168, an interior seat joint member 170 and a water stopping packing member 172. The spray sub-assembly 160 also includes an exchanging cartridge member 174, a water out seat joint member 176, a fourth O-ring member 178, a chrome spray adjusting ring 180, a rubber spray adjusting ring 182, a water out seat member 184, a mesh filter member 186 and a filter fixed ring 188. The seat joint opening 166 at the non-threaded end 163 of the seat joint member 162 is used to receive the O-ring members 156 and 158, as well as the ball joint member 139 at the second end 154 of ball joint 136 of the flow compensator sub-assembly 130. The ball joint member 139 allows the seat joint member 162 to swivel in 360 degree rotation R in either a clockwise or counter-clockwise direction. The interior seat joint member 170 and the third O-ring member 168 are removably received within seat joint opening 166 of seat joint member 162. The water stopping packing member 172 is detachably connected to the interior seat joint member 170, as shown in FIG. 7 of the drawings. The water stopping packing member 172 is also adjacent and in contact with a screen section 175 of the exchanging cartridge member 174. The exchanging cartridge member 174 is received within a seat joint opening 177 of the water out seat joint member 176. The interior seat joint member 170, the water stopping packing member 172, the exchanging cartridge member 174 and the water out seat joint member 176 are all internal spray components of the spray sub-assembly 160 that are used to produce a needle spray pattern $SP_N$ or a bubble stream (full) spray pattern $SP_B$. The fourth O-ring member 178 and the water out seat joint member 176 are received within a chrome spray ring opening 181 of the chrome spray adjusting ring 180, as shown in FIGS. 5 and 7. The chrome spray adjusting ring 180 is received within a rubber spray ring opening 183 of the rubber spray adjusting ring 182. The spray adjusting rings 180 and 182 move backward and forward in a lateral motion in order to give the aforementioned needle spray pattern $SP_N$ or the bubble stream (full) spray pattern $SP_B$, as shown in FIG. 6 of the drawings, when in operational use. The rubber spray ring opening 183 of rubber spray adjusting ring 182 is used for receiving the water out seat member 184. The mesh filter member 186 is adjacent and in contact with the fourth O-ring member 178 and the fourth O-ring member 178 is adjacent and in contact with the water out seat joint member 176. The mesh filter member 186 is fixed in place with the filter fixed ring 188, as shown in FIG. 5 of the drawings. The water out seat member 184 includes a plurality of spaced-apart (in a circular configuration) water openings 185 for producing the aforementioned spray patterns $SP_N$ or $SP_B$, etc. An annular flow channel 190 is provided in the assembled configuration (See FIGS. 5 and 6) for the flow of water W through the kitchen aerator 100. The annular flow channel 190 is configured to be oriented along a longitudinal axis X of the kitchen aerator 100, as shown in FIG. 7.

OPERATION OF THE PRESENT INVENTION

In operation, as shown in FIGS. 2 and 3 of the drawings, the kitchen aerator or faucet aerator 10 having a flow compensator sub-assembly 30 operates in the following manner. The user initially attaches the exterior thread section 37*a* of ball joint 36 to the connection ring 14 of kitchen faucet 12, as depicted in FIG. 2. The user now turns "ON" the kitchen faucet 12 for the inflow of water W from the kitchen faucet 12 through the annular flow channel 90 along the longitudinal axis X of the attached kitchen aerator 10. The next step has the user adjusting the flip lever 46, such that the flip lever 46 is movable from a first water flow position $P_1$ (the water flow opening 41 of pin 40 is aligned with annular flow channel 90 for the maximum flow of water W through the annular flow channel 90) to a second water flow position $P_2$ (the water flow opening 41 of pin 40 is partially blocked, thus minimizing the flow of water W) in order to regulate the water flow rate for a particular spraying pattern. In the last step, the user adjusts the spray adjusting rings 80 and 82 to either a forward spray position $SP_F$ or a rearward spray position $SP_R$ along the X axis, as shown in FIGS. 2 and 3 of the drawings, in order to give the water out seat member 84 (nozzle head) a needle spray pattern $SP_N$ or a bubble stream (full) spray pattern $SP_B$. Additionally, the user can adjust the seat joint member (swivel member) 62 about the ball joint member 39 which allows the seat joint swivel member to swivel in a 360 degree rotation in either a clockwise or counterclockwise direction allowing the user to give a particular direction of spray pattern to the kitchen aerator 10.

ADVANTAGES OF THE PRESENT INVENTION

Accordingly, an advantage of the present invention is that it provides for a kitchen or faucet aerator that includes a flow compensator in order to allow higher flow rates of water at lower water pressures; such that the flow compensator's unique design will give results of higher flow rates (60 to 80 PSI) at lower water pressures while maintaining a desired maximum out put at 80 PSI and give flow rates that are within a flow variance range of 15% from 20 PSI to 80 PSI.

Another advantage of the present invention is that it provides for a kitchen aerator having a flip lever within the flow compensator, such that the flip lever is bent at an angle for easy use in order to regulate the water flow rate for a particularly spraying pattern.

Another advantage of the present invention is that it provides for a kitchen aerator having a minimum number of moving parts for easy replacement of defective, damages or broken component parts of the kitchen aerator.

Another advantage of the present invention is that it provides for a kitchen aerator that is durable, lightweight and easy to use by the user.

A further advantage of the present invention is that it provides for a kitchen aerator having a flow compensator that can be mass-produced in an automated and economical manner and is readily affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A faucet aerator incorporating a flow compensator in order to allow higher flow rates of water at lower water pressures through said faucet aerator, comprising:

a) a faucet aerator having an annular flow channel positioned along a longitudinal axis through said faucet aerator for passing of water through said annular flow channel;

b) said faucet aerator including a flow compensator sub-assembly connected to a spray sub-assembly forming said faucet aerator;

c) said flow compensator sub-assembly including a flow compensator member having a plurality of spaced-apart water hole openings allowing water at a high flow rate therethrough, a seat member seating and holding said flow compensator in place and a flow compensator ball joint having an exterior threaded section connecting to a connection ring of a faucet, a pin receiving opening receiving a pin therethrough and a ball joint member for receiving a seat joint swivel member thereon allowing said swivel member to swivel in a 360 degree rotation in either a clockwise or counterclockwise direction;

d) said pin including a water flow opening, a first arm opening and a second arm opening and a flip lever having a first arm and a second arm; said first arm opening and said second arm opening of said pin receiving said first arm and said second arm of said flip lever therein, respectively; and e) said flip lever being movable from a first water flow position to a second water flow position in order to regulate water flow rate for a particular spraying pattern.

2. A faucet aerator in accordance with claim 1, wherein said spray sub-assembly including said seat joint swivel member, an exchanging cartridge member, a spray head seat joint member, spray adjusting rings and a spray head member producing a needle spray pattern or a bubble stream spray pattern from said faucet aerator.

3. A faucet aerator in accordance with claim 2, wherein spray adjusting rings being movable to either a forward spray position or a rearward spray position in order to produce said needle spray pattern or said bubble stream spray pattern, accordingly.

4. A faucet aerator in accordance with claim 1, wherein said flow rates through said flow compensator of said plurality of spaced-apart water hole openings are in the range of 20 PSI to 80 PSI.

5. A faucet aerator in accordance with claim 1, wherein said water flow opening of said pin is adjacent and in a fully opened configuration to said annular flow channel within said flow compensator ball joint of said flow compensator sub-assembly for when said flip lever is in said first water flow position.

6. A faucet aerator in accordance with claim 1, wherein said water flow opening of said pin is adjacent and in a partially opened configuration to said annular flow channel within said flow compensator ball joint of said flow compensator sub-assembly for when said flip lever is in said second water flow position.

* * * * *